US006588399B2

(12) United States Patent
Okamoto et al.

(10) Patent No.: US 6,588,399 B2
(45) Date of Patent: Jul. 8, 2003

(54) FUEL INJECTION METHOD OF INTERNAL COMBUSTION ENGINE AND FUEL INJECTION APPARATUS OF INTERNAL COMBUSTION ENGINE

(75) Inventors: Yoshio Okamoto, Minori (JP); Yuzo Kadomukai, Ishioka (JP); Ayumu Miyajima, Narita (JP); Masami Nagano, Hitachinaka (JP); Tadashi Someno, Hitachinaka (JP)

(73) Assignees: Hitachi, Ltd., Tokyo (JP); Hitachi Car Engineering Co. Ltd., Ibaraki (JP)

( * ) Notice: Subject to any disclaimer, the term of this patent is extended or adjusted under 35 U.S.C. 154(b) by 66 days.

(21) Appl. No.: 09/789,624

(22) Filed: Feb. 22, 2001

(65) Prior Publication Data

US 2001/0022170 A1 Sep. 20, 2001

(30) Foreign Application Priority Data

Feb. 22, 2000 (JP) ..... 2000-050537

(51) Int. Cl.[7] ..... F02M 61/18; F02M 69/04
(52) U.S. Cl. ..... 123/305; 123/306; 123/430
(58) Field of Search ..... 123/294–309, 123/429–433

(56) References Cited

U.S. PATENT DOCUMENTS

| | | | | |
|---|---|---|---|---|
| 5,713,327 A | * | 2/1998 | Tilton et al. | 123/299 |
| 5,727,520 A | * | 3/1998 | Wirth et al. | 123/305 |
| 6,125,818 A | * | 10/2000 | Okamoto et al. | 123/305 |
| 6,334,427 B1 | * | 1/2002 | Nakayama et al. | 123/305 |
| 6,345,601 B1 | * | 2/2002 | Miyajima et al. | 123/305 |

* cited by examiner

*Primary Examiner*—Paul J. Hirsch
(74) *Attorney, Agent, or Firm*—Antonelli, Terry, Stout, & Kraus, LLP

(57) ABSTRACT

In a fuel injection apparatus of an internal combustion engine comprising a fuel injector, an intake valve device for opening and closing an intake port, and an intake air flow control device arranged in an upstream side of the intake valve device, a fuel injection is synchronized with an intake stroke of the engine. A fuel spray is oriented to an inner wall face which is positioned in an opposite side to an inner wall face of a cylinder heads in a fuel injector side and the fuel spray is transported by an air flow having a strong fluidization which is entered from the intake air control device. In a port injection lean burn engine, an adhesion to the wall face according to the fuel spray can be reduced, and a quality and a formation state of an air-fuel mixture in a cylinder can be improved.

16 Claims, 8 Drawing Sheets

FIG. 1 ( a )
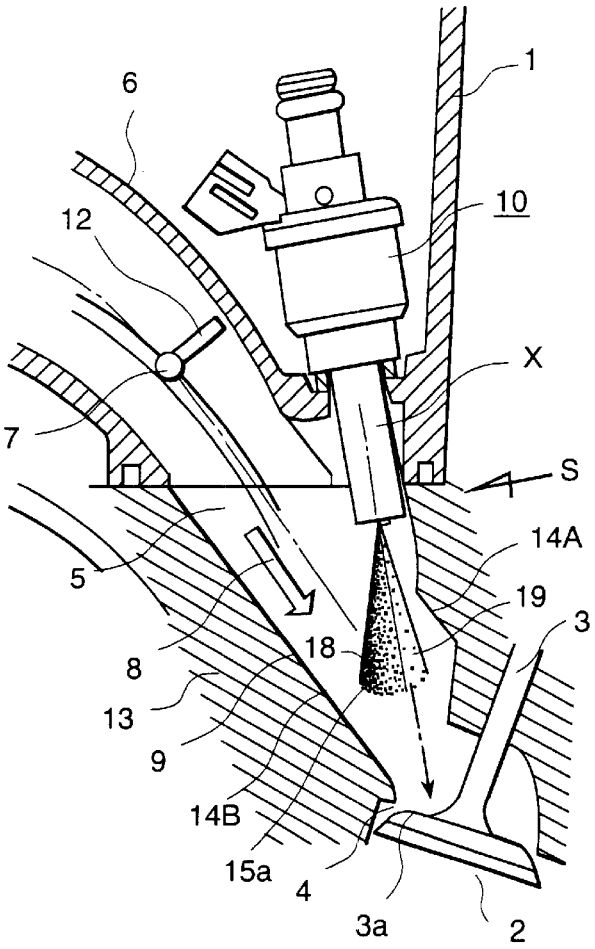
FIG. 1 ( b )
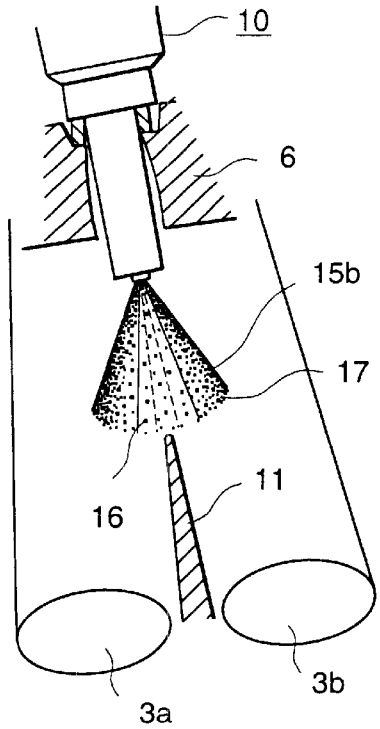
FIG. 1 ( c )
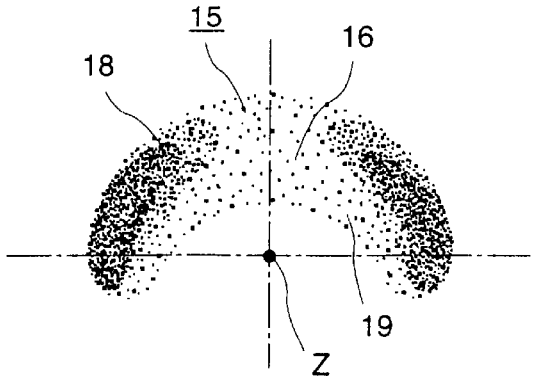

FIG. 3 ( a )
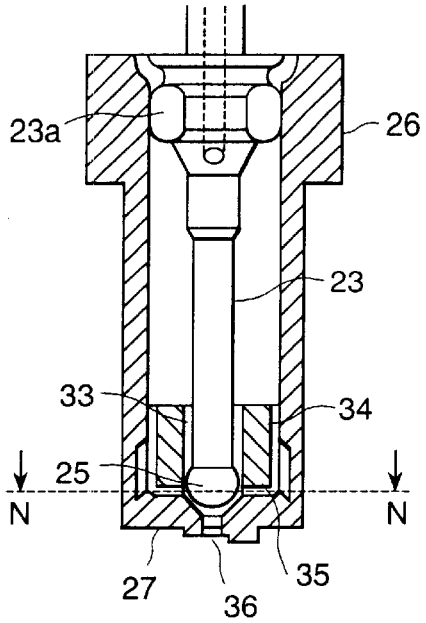
FIG. 3 ( b )
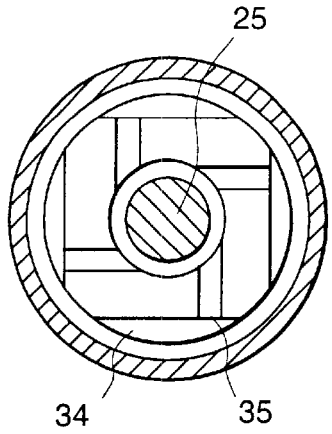
FIG. 4 ( a )
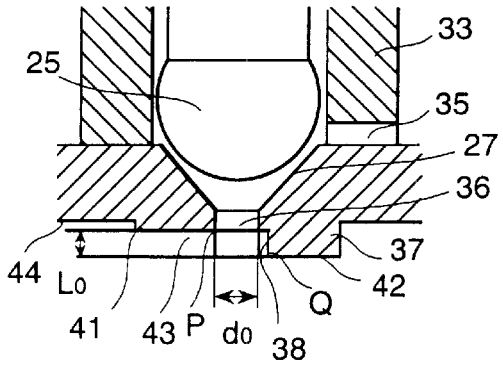
FIG. 4 ( b )
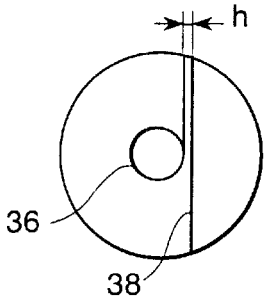

FIG. 5 ( a )
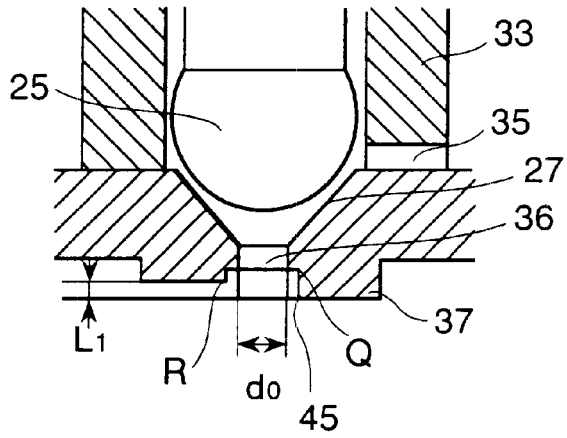
FIG. 5 ( b )
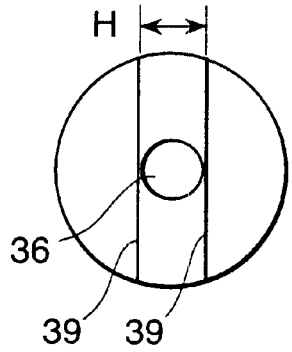
FIG. 6
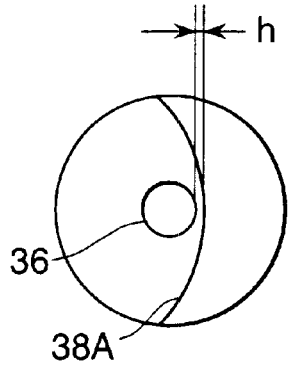

FIG. 11 ( a )
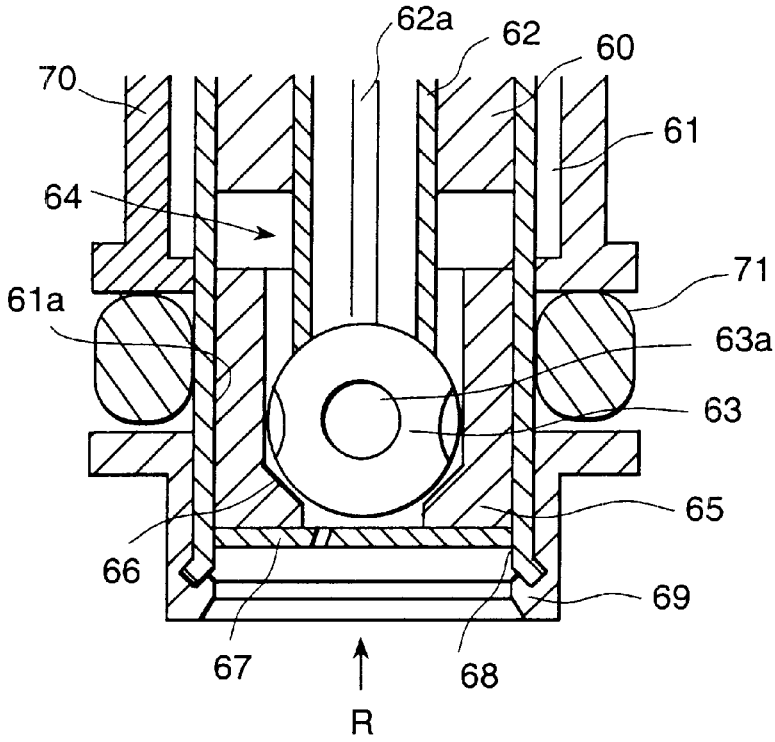
FIG. 11 ( b )
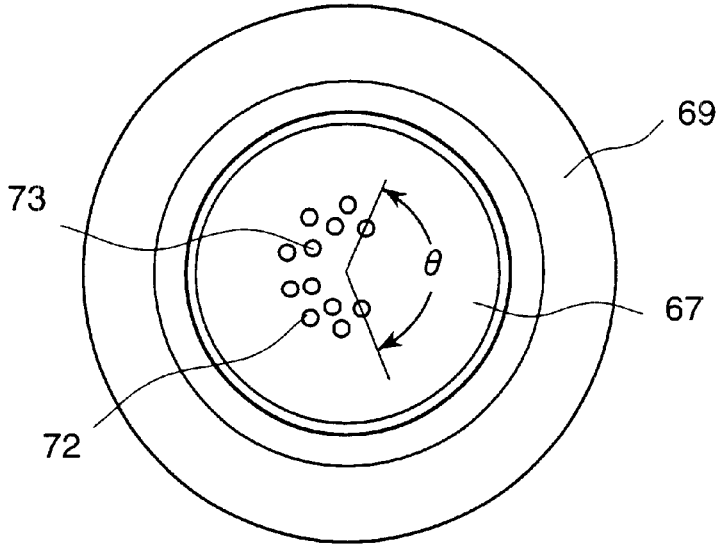

FIG. 12 ( a )
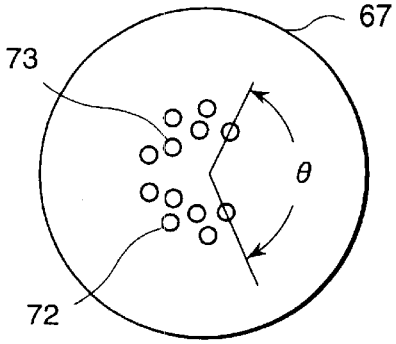
FIG. 12 ( b )
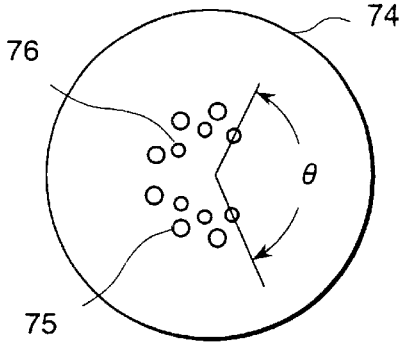
FIG. 12 ( c )
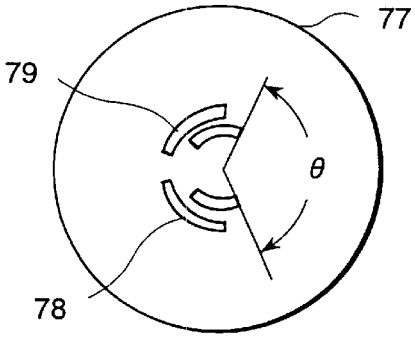
FIG. 12 ( d )
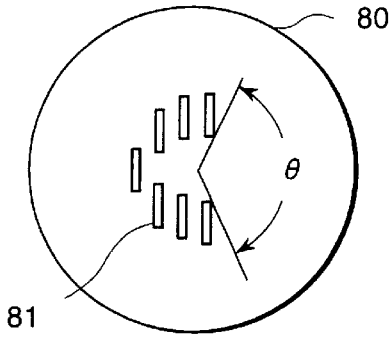
FIG. 13
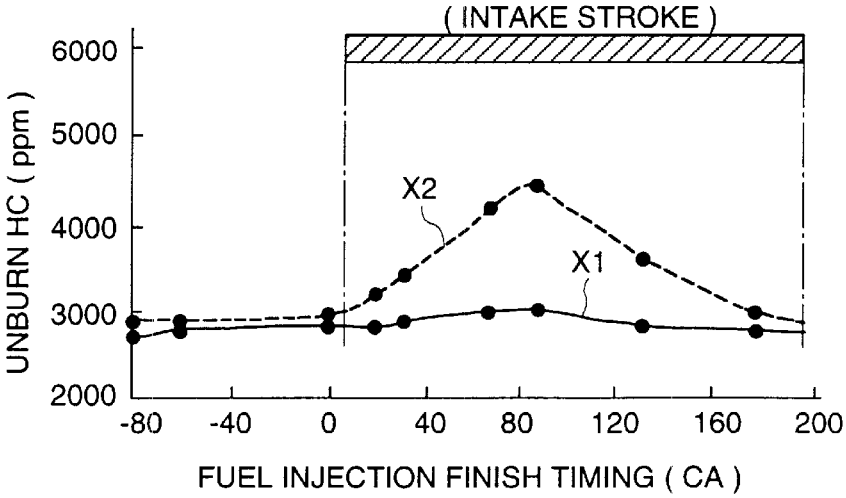

FUEL INJECTION METHOD OF INTERNAL COMBUSTION ENGINE AND FUEL INJECTION APPARATUS OF INTERNAL COMBUSTION ENGINE

BACKGROUND OF THE INVENTION

1. Technical Field

The present invention relates to a fuel injection method of an internal combustion engine and in particularly to a fuel injection method of an internal combustion engine in which an atomization of a fuel spray injected from a fuel injector is heightened and the fuel spray is supplied to an intake manifold, and a fuel injection apparatus of an internal combustion engine and in particularly to a fuel injection apparatus of an internal combustion engine in which an atomization of a fuel spray injected from a fuel injector is heightened and the fuel spray is supplied to an intake manifold.

2. Prior Art

Recently, from an aspect of an environment protection, exhaust gas regulations and fuel consumption regulations in the automobile field have been enforced exclusively from year to year. As a result of these requirements, improvements in an exhaust gas purification and the fuel consumption of an internal combustion engine and various kinds of internal combustion engines (such as a lean burn engine and a direct injection engine etc.) have been proposed.

In the above stated direct injection engine, there is a problem from a manufacturing cost in accordance with many alternations about an engine base, and it has needed to provide a piston head which has a specific shape configuration and requires some surrounding devices. As a result, there is continued desire for an improvement of combustion in an internal combustion engine using the above stated lean burn engine.

The above stated lean burn engine is an engine in which an air-fuel mixture is performed to lean and burn by employing a fuel injection system in which a multi point injection (MPI) system for carrying out a fuel injection from a fuel injector which is provided on a respective cylinders. The fuel injection is synchronized to an intake stroke so that a lean characteristic of the air-fuel mixture is performed.

On the other hand, by gathering a rich air-fuel mixture in which a spark is enabled to carry out at a surrounding portion of an ignition plug, an improvement of the fuel consumption can be attained in the internal combustion engine and an improvement of an exhaust gas purification can be attained in the internal combustion engine. As to the techniques relating to the improvements of the lean burn engine, such techniques are shown in Japanese application patent laid-open publication Hei 8-177,689 and Japanese application patent laid-open publication Hei 11-159,424.

In the above stated prior arts, in light of the adhesion of the injection fuel to an intake port, and the cylinder etc. of the engine, this adhesion invites an aggravation of the exhaust gas purification. In other words, to dissolve a fuel wet characteristic, an atomization of particle diameters (grain diameter or grain sizes), such as 80–100 $\mu$m, of the injection fuel and further an advance arrangement structure of an injection hole portion of the fuel injector (the injection hole portion of the fuel injector is near the intake port) are carried out. The fuel consumption in the internal combustion engine and the improvement of the exhaust gas performance in the internal combustion engine are thereby attained.

In accordance with the advance arrangement structure of the injection hole portion of the fuel injector, by carrying out the atomization of the particle diameters in the above stated injection fuel, however the aggravation of the exhaust gas performance in the internal combustion engine according to the adhesion of the injection fuel to the cylinder etc. may be dissolved.

However, since the kinetic energy of the above stated atomized injection fuel is smaller than the kinetic energy of the injection fuel having the ordinary particle diameters, there is a problem of a delay in time of the injection, fuel in which a penetrating force of the fuel injection is made small and a time is delayed for the injection fuel to reach the cylinder from the fuel injection apparatus (i.e., the fuel injector). Because of the delay in time of the injection fuel, there is a problem in which all of the injection fuel can not enter in a combustion chamber of the engine during an intake stroke time. In other words, the delay in time of the injection fuel of the fuel injector to the combustion chamber of the engine is a transportation delay.

Herein, the inventors of the present invention have determined that the delay in time of the injection fuel (all of the fuel can not be entered in the combustion chamber of the engine during the intake stroke time) makes it difficult for the injection to be synchronized to the intake stroke time in the fuel injection system in which the MPI (multi-point injection) system is performed. As a result, it is necessary to reduce the delay in time of the injection fuel during the intake stroke time.

However, in the above stated prior art, only the fuel wet characteristic can be reduced. There is no particular consideration about the dissolution of the delay in time of the injection fuel during the intake stroke time or the transportation delay of the injection fuel during the intake stroke time.

SUMMARY OF THE INVENTION

An object of the present invention is to provide a fuel injection method of an internal combustion engine and a fuel injection apparatus of an internal combustion engine. In such a fuel injection apparatus (i.e., a fuel injector) performed by a MPI (a multi-point injection) system, a quality of an air-fuel mixture in a cylinder and a formation condition of the air-fuel mixture in a cylinder can be improved.

Another object of the present invention is to provide a fuel injection method of an internal combustion engine and a fuel injection apparatus of an internal combustion engine, in a fuel injection apparatus (a fuel injector) which is performed by a MPI (a multi-point injection) system, so that an atomization degree of a fuel spray injected from a fuel injector can be more heightened (i.e., increased) and the fuel spray into an combustion chamber can be more suitably supplied.

A further object of the present invention is to provide a fuel injection method of an internal combustion engine and a fuel injection apparatus of an internal combustion engine. In such a fuel injection apparatus (a fuel injector) performed by a MPI (a multi-point injection) system, an orientation (i.e., a directionality or a directional movement) of a fuel spray to be subjected to the injection of a fuel injector can be suitably adjusted and a shape of the fuel spray can be suitably adjusted.

A further object of the present invention is to provide a fuel injection method of an internal combustion engine and a fuel injection apparatus of an internal combustion engine. In such a fuel injection apparatus (a fuel injector) performed by a MPI (a multi-point injection) system, a delay time of an injection fuel injected from a fuel injector can be lessened.

In a fuel injection apparatus of an internal combustion engine according to the present invention, basically, the fuel injection apparatus of the internal combustion engine comprises an intake valve device for opening and closing an intake port, a fuel injector driven in accordance with a control signal from an engine control device which is arranged in an upstream side of the intake valve device, and an intake air flow control device arranged near an upstream side of the fuel injector. A fuel injection is synchronized with an intake stroke of the internal combustion engine. A fuel spray injected from the fuel injector is generated to orient to an inner wall face which is an opposed side of an inner wall face of a cylinder head of a side of the fuel injection. When the intake valve device is opened, an intake air flow having a strong fluidization, which flows in from the intake air control device, transports the fuel spray.

In the fuel injection apparatus of the internal combustion engine according to the present invention, the fuel injection system in which during the intake stroke a multi-point injection (MPI) system is synchronized and an optimum fuel injection period is established. The mixture of the fuel spray injected from the fuel injection with the intake air flow having the strong fluidization is promoted effectively and the fuel spray is transported to the respective cylinders such that an improvement about the quality of the air-fuel mixture can be obtained. The atomization of the fuel spray can be attained using the fuel upstream swirl type fuel injector. Further, a fuel spray is formed and directed to the intake airflow having the strong fluidization. Further, since the distance between the fuel injection hole of the fuel injector to the intake valve of the respective cylinder is shortened, the lowering of the penetration force, which has been the problem according to the atomization of the fuel spray in the prior art, can be compensated. Further, a reduction in cost can be obtained.

Further, in an embodiment of the fuel injection apparatus of the internal combustion engine according to the present invention, the injection hole axis of the fuel injector is arranged to direct in the dish port of the intake valve. Further, the fuel spray injected from the fuel injector is generated and oriented to the inner wall face, which is the side opposed to the inner wall face of the intake valve in the fuel injector side. Accordingly, as to the fuel spray configuration, in the inner wall face side of the cylinder head in the fuel injector side, the spread angle is small (i.e., the fuel spray amount is small). In the inner wall face side of the opposed side, the spread angle is large (i.e., the fuel spray amount is large). As a result, the adhesion amount of the fuel spray to the inner wall face of the cylinder head can be reduced.

Further, in another embodiment, the injection hole axis of the fuel injector is arranged to direct in the dish port of the intake valve, and further the fuel spray injected from the fuel injector is deflected to the inner wall face side of the side opposed with the inner all face of the cylinder head in the fuel injector side. Also, in the cross-section that is orthogonal to the injection hole axis of the fuel injector, the fuel spray is generated to have the flatness shape (for example, with the two intake valves the fuel spray is substantially concentrated) and when the intake valve is opened, the intake air flow having the strong fluidization which is flown from the intake air flow control apparatus can be transported.

Additionally, since the minute spray injected from the fuel injector is generated flatly and deflective, and when the injection hole axis of the fuel injector is arranged in the dish port of fuel intake valve, the fuel adhesion to the inner wall face of the cylinder head which is made as the problem in an axial symmetric spray can be lessened.

As a result, since this does not require an alteration of the layout for the base engine, a reduction in the cost can be attained. Further, by suiting the flatness degree and the deflection degree in the desirable form of the fuel spray can be selectively in compliance with request, it is possible to obtain the correspondence of the various kinds and comparative, styles in the fuel spray.

Further, according to the compatibility of the atomization of the fuel spray, an air-fuel mixture having good quality can be generated, and an improvement of the exhaust gas purification and the fuel consumption can be attained.

BRIEF DESCRIPTION OF THE DRAWINGS

FIG. 1(*a*) is a partially cross-sectional view showing one cylinder of a multi-cylinder internal combustion engine in which a fuel injection apparatus (a fuel injector) of one embodiment according to the present invention in which the fuel injection apparatus is applied to an intakes manifold of an internal combustion engine;

FIG. 1(*b*) is a simplified view showing an intake valve, which is seen from a S direction of FIG. 1(*a*), and showing an aimed direction of a fuel spray of the injection fuel;

FIG. 1(*c*) is a tomogram-sectional view showing the fuel spray of the injection fuel according to the present invention;

FIG. 3(*a*) is a cross-sectional view showing a valve portion of the fuel injector according to the present invention;

FIG. 3(*b*) is a plan view showing the valve portion showing the fuel injector from a N direction cross-sectional view of FIG. 3(*a*);

FIG. 4(*a*) is a partially cross-sectional view showing a L form type injection hole portion of the fuel injector in which a L shape injection hole portion in which a fuel spray is enable for the control of the fuel spray shape;

FIG. 4(*b*) shows a plan view showing the valve portion of the fuel injector of FIG. 4(*a*);

FIG. 5(*a*) is a partially cross-sectional view showing of a rectangle type hole portion in which the fuel spray is enable to the control of the fuel spray shape;

FIG. 5(*b*) shows a plan view showing the valve portion of the fuel injector of FIG. 5(*a*);

FIG. 6 is a modified example of FIG. 4(*b*) and a plane view showing the valve portion of the fuel injector;

FIG. 7(*b*) is a cross-sectional view showing a fuel spray of a fuel injector having the L type injection hole;

FIG. 11(*a*) is a cross-sectional view showing a fuel injector of another embodiment according to the present invention;

FIG. 11(*b*) is a plan showing an injection nozzle portion of the fuel injector of FIG. 11(*a*);

FIG. 12(*a*) is a plan showing an injection nozzle portion of a fuel injector of a further embodiment according to the present invention;

FIG. 12(*b*) is a plan showing an injection nozzle portion of a fuel injector of a further embodiment according to the present invention;

FIG. 12(*c*) is a plan showing an injection nozzle portion of a fuel injector of a further embodiment according to the present invention; FIG. 12(*d*) is a plan showing an injection nozzle portion of a fuel injector of a further embodiment according to the present invention; and FIG. 13 is a relationship graph between an unburned hydrocarbon (HC) and a fuel injection finish timing according to the prior art and the present invention.

DESCRIPTION OF THE INVENTION

Figure 2:
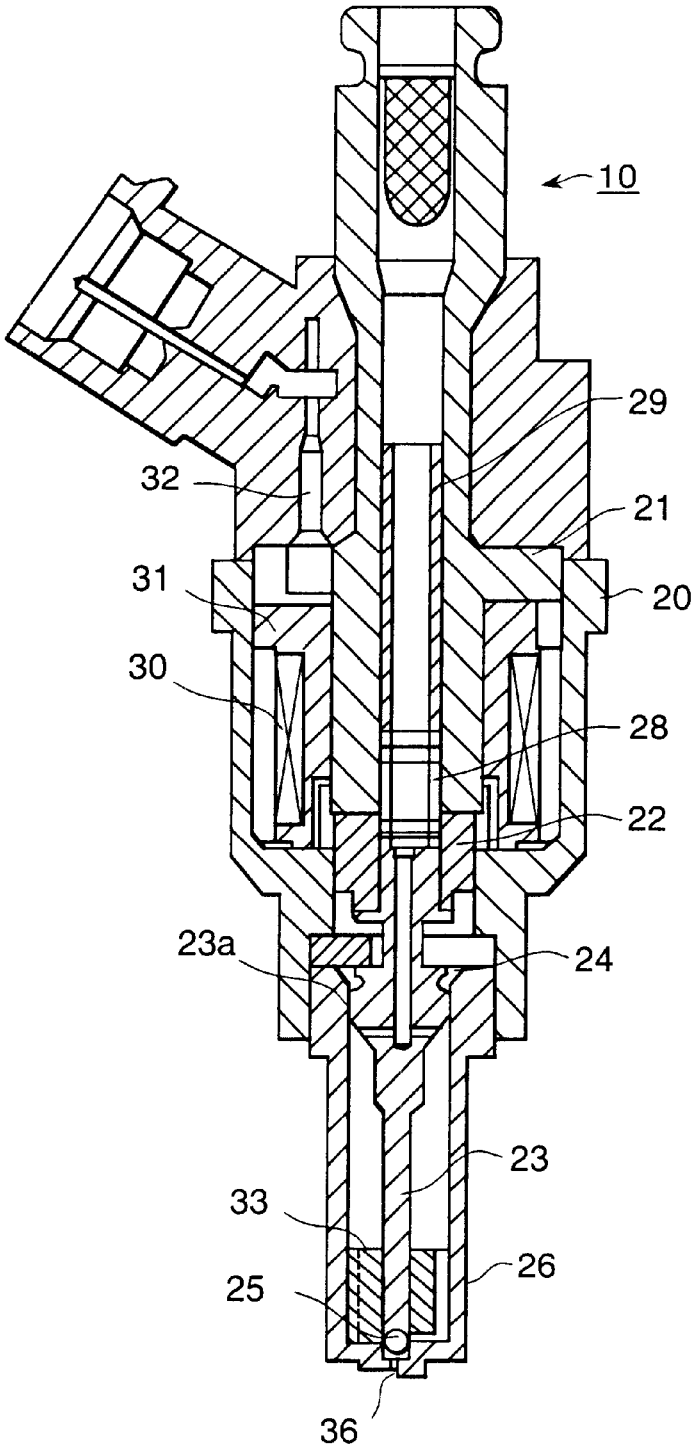
FIG. 2 is a longitudinal cross-sectional view showing the fuel injector shown in FIG. 1(*a*) according to the present invention.

Hereinafter, a fuel injection method of an internal combustion engine and a fuel injection apparatus of an internal combustion engine of one embodiment according to the present invention will be explained referring to the drawings.

FIG. 1(*a*) and FIG. 1(*b*) are views showing a mounting state for mounting to a multi-cylinder internal combustion engine of a fuel injection apparatus (i.e., a fuel injector) of one embodiment according to the present invention. FIG. 1(*a*) is a partially cross-sectional view of the mounting state of the fuel injector, and FIG. 1(*b*) is a view which seen from a S direction of FIG. 1(*a*) and showing a positional relationship between an intake valve and the fuel injector.

A reference numeral 1 is one of the cylinders of the multi-cylinder internal combustion engine, a reference numeral 2 is a combustion chamber, a reference numeral 3 is an intake valve for opening and closing an intake port 4, a reference numeral 5 is an intake air passage having a central partition wall 11 for partitioning the intake port 4 and for communicating in an upstream side of the intake port 4, and a reference numeral 6 is an intake manifold.

A reference numeral 7 is an intake air flow control device, a reference numeral 8 is an intake air flow, a reference numeral 9 is an inner wall face of the intake air passage 5 which is opposed to an inner wall face of a side of an electromagnetic fuel injector 10. The intake air flow control device 7 has an opening and closing valve 12. A reference numeral 13 is a cylinder head and this cylinder head 13 has one inner wall portion 14A at a side of the fuel injector 10 and another inner wall portion 14B which is opposed to the one inner wall portion 14A.

In this embodiment according to the present invention, the electromagnetic fuel injector 10 is installed to the intake manifold 6. The two intake ports 4 are arranged in parallel and in this embodiment, a fuel spray 15 (15*a*, 15*b*) is injected toward a central partition wall 11 of the cylinder head 13.

The fuel injectors 10 are arranged one by one of the cylinders 1 to an upstream side of the intake valve 3 and accordingly a fuel injection system of the internal combustion engine is provided for performing a multi-point injection (MPI) system. To improve a quality and a formation state of the air-fuel mixture in the cylinder 1, an atomization degree is heightened (or increased) in a fuel spray 15, and as an atomization means the fuel swirl type electromagnetic fuel injector 10 is used.

However, when an axial synchronizing spray is generated (as in the prior art), it causes a problem in which fuel adhesion occurs to an inner wall face to an intake manifold in a surrounding portion of a fuel injector and an intake air passage and the adhesion matter adheres to the above stated inner wall face of the intake manifold. Further, it causes a problem since the atomization degree of the fuel spray becomes high and a penetrating force of the fuel spray of the injection fuel lowers and causes a transporting delay (i.e., a delay in time) of the injection fuel to a combustion chamber.

To solve these problems in the prior arts, in this embodiment according to the present invention, an orientation of the fuel spray 15 and the shape and an injection period of the fuel spray 15 can be suitably adjusted. Namely, the opening and closing valve 12 of the intake air flow control device 7 is opened and closed, and to the intake air flow 8 in which a velocity for passing through is speed up, the minute spray 15*a* is ridden and a mixture of the air to the fuel is promoted and then all of the fuel spray 15 can be transported to enter the combustion chamber 2 of the engine without the transportation delay (i.e., the delay in time) of the injection fuel.

More specifically, the fuel injection from the fuel injector 10 is carried out by suiting a most suited timing of the intake stroke of the respective cylinder 1 and according to this timing in addition to the fuel injector 10 the intake air flow control device 7 are driven. In the intake air flow control device 7, as shown in the figure, during a closing time a passage area of the intake manifold 6 is narrowed and the velocity of the intake air flow 8 is speed up and a tumble flow is generated in the combustion chamber 2 of the engine.

Herein, the difference between a fuel injection timing according to the prior art and a fuel injection timing of this embodiment according to the present invention will be explained.

FIG. 13 shows a relationship between a fuel injection finish timing and the unburned hydrocarbon (HC). In this figure, an intake stroke timing is also shown. These relationships show a tendency of a test result under the conditions of the rotation number of the engine of 2000 rpm, the intake manifold pressure of −40 KPa, the water temperature of 80–40 degrees, the ignition time of 16 degrees BTDC, and the air-fuel ratio of 14.7.

In the fuel injection apparatus according to the prior art, the particle diameter of the fuel to be subjected to the injection is 80–100 $\mu$m. In a case of the fuel injection during the intake stroke, in other words the fuel injection finish timing is going to carry out the intake stroke, it is tended to increase abruptly the amount of the hydrocarbon (HC). The reasons are caused that the larger diameter particles of the fuel which has gone through the intake port adhere to the wall face of the combustion chamber and then the combustion gets worse. According to the after burning phenomenon and so on, such as the fuel vaporized under the long time is burned after, a fuel rich state appears.

On the other hand, in accordance with the fuel injection apparatus of this embodiment, since the particle diameter of the fuel is 35 $\mu$m degree, the increase of the hydrocarbon (HC) is not caused. The reasons are that since almost all of the particles of the fuel are transported by the intake air flow, then the fuel adhesion to the wall face of the intake manifold and to the wall face of the combustion chamber can be avoided. In other words, a homogenous and good air-fuel mixture can be formed.

In the fuel injection apparatus according to the prior art, under the timing (the state) in which the intake port is closed, the fuel is injected. Namely, the fuel injection timing is a vicinity of BTDC 58 degrees (in the exhaust stroke 58 degrees). The injected fuel is gathered and stayed to the dish port of the intake valve, and in the dish port having heated with the high temperature the injected fuel is nearly evaporated. However, since it is inevitable to present the fact in which the fuel not being evaporated enters into the combustion chamber in the time when the intake valve is opened, and further since the control for forming the good quality air-fuel mixture is difficult and so on, there is a limitation about the reduction of the hydrocarbon (HC).

On the other hand, in accordance with the embodiment according to the present invention, in the intake stroke in which the intake port is opened the fuel is injected, or to be gotten the injection finish timing of the fuel the injection timing of the fuel is controlled. In the intake stroke, the fuel is intended to be flown into the combustion chamber and further in essence the injected fuel does not stay upstream of the intake manifold. As a result, in the embodiment according to the present invention, the fuel is not evaporated substantially in the intake manifold but rather the fuel is transported into the combustion chamber.

In the embodiment according to the present invention, in the above stated state, by the provision of the intake air flow control device, in the lateral cross-section of the intake passage, the intake air flow is controlled to generate the distribution about the intake air flow velocity and the distribution of the intake air flow amount, to the region in which the intake air flow velocity is heightened (or increased) and the intake air flow amount is increased, the fuel can be injected. As a result, the fuel can be transported by riding the intake air flow having the speed-up velocity fuel and the large quantity fuel, and the delay of the fuel transportation can be lessened, and further the fuel adhesion to the intake valve and to the intake manifold can be lessened. Further, to form the particle diameter of the fuel smaller than 80 $\mu$m, preferably, it is preferable to inject the fuel having the particle diameter of 30–50 $\mu$m.

The shape of the fuel spray 15 from the fuel injector 10, as shown in FIG. 1(*a*), to the inner wall face 14A of the cylinder head 13 includes a small spread angle (a fuel spray amount is small). The shape of the fuel spray 15 to the opposed wall face 14B side of the cylinder head 13 includes a large spread angle (the fuel spray amount is large). Further, as shown in FIG. 1(*b*), the fuel spray 15*b* is generated to avoid the adhesion of the injection fuel to the central partition wall 11 of the cylinder head 13 and to orient to dish portions 3*a* and 3*b* of the respective intake valves 3.

Further, in another embodiment according to the present invention, an injection hole axial of the fuel injector 10 is arranged to direct to the dish portions 3*a* and 3*b* of the intake valve 3. The fuel spray 15 injected from the fuel injector 10 is deflected to the inner wall face 14B side of the cylinder head 13, which is an opposed side against the inner wall face 14A of the cylinder head 13 in the fuel injector 10 side. The fuel spray 15 is generated to form a flat shape (a shape for substantially concentrated two directions or two orientations) in an orthogonal tomogram-section to the injection hole axial of the fuel injector 10, as shown in FIG. 1(*c*).

And further in this embodiment according to the present invention, when the intake valve 3 is opened, the intake air flow 8 having a strong fluidization which is flown from the intake air flow control device 7 transports the fuel spray 15 and all of the fuel spray 15 enters into the combustion chamber 2 of the engine.

As shown in FIG. 1(*b*), the fuel spray 15*b* injected from the fuel injector 10 comprises a central portion (a lean (light) concentrated region) 16 and an outer portion 17. The outer portion 17 is formed with a rich spray portion (a richly concentrated region) 18 having a wide angle spread in a peripheral portion and a medium spray portion (a medium concentrated region) 19 having a narrow angle spread. The central portion 16 of the fuel spray 15 is formed with a thin spray portion. With the outer portion 17 and the central portion 16 of the fuel spray 15, an integrated asymmetric spray body 15 as shown in FIG. 1(*c*) is generated in a horizontal direction. As a result, the integrated asymmetric spray body 15 comprises the lean concentrated region, 16, the medium concentrated region 19, and the richly concentrated region 18. In FIG. 1(*c*), a reference numeral Z indicates a center of the injection hole.

The rich spray portion (the richly concentrated region) 18 having the wide angle spread of the fuel spray 10 is oriented to the inner wall face 14B which is opposed to the intake manifold arrangement wall of the intake manifold 6 to which the fuel injector 10 is arranged. Further, the rich spray portion (the richly concentrated region) 18 of the fuel spray 15*a* is oriented symmetrically to the central partition wall 11 of the cylinder head 13 which is positioned in a central portion of the parallel arranged two dish ports 3*a* and 3*b* of the intake valve 3.

A flow velocity distribution of the fuel spray 15 in a lateral cross-section of the intake air passage 5 to the air for flowing into the intake air passage 5 is carried out to concentrate the fuel in a region formed on the lateral cross-section of said intake air passage and heighten the flow velocity of the region of the lateral cross-section of the intake air passage 5 according to the intake air flow control device 7. The fuel which has injected to the region rides on the intake air flow 8 in which the flow velocity has heightened and the fuel is transported into the combustion chamber 2 of the engine. The spread angle of the fuel spray to the wall face portion lab is wider than the spread angle of the fuel spray to the wall face portion 14A.

Next, a structure of the fuel injector 10 to generate the fuel spray 15 described above and an operation thereof will be explained referring to FIG. 2 to FIG. 4. FIG. 2 is a longitudinal cross-sectional view showing the fuel injector 10, FIG. 3, is an enlarged cross-sectional view of a valve portion of the fuel injector 10, and FIG. 4 is a cross-sectional view showing a structure of an injection hole portion of the fuel injector 10 for enabling to control the shape of the fuel spray 15.

The fuel injector 10 carries out the injection of the fuel by carrying out an opening and a closing of a seat portion in accordance with an on-off signal having a duty cycle which is executed by a control unit not shown in figure. A magnetic field circuit comprises a cylindrical form yoke 20 having a bottom portion, a core 21, and a plunger 22 opposed with an air gap to the core 21. To this plunger 22, a rod 23 having a fuel passage 24 in an interior portion thereof a valve body 25 joined to this rod 23 are combined with, the valve body 25 carries out an opening and a closing of a seat face 27 which is formed in a nozzle portion 26.

Further, in the fuel injector 10, as an elastic member for pressing under pressure he valve body 25 to the seat face 27, a spring member 28 is provided in a central portion of the core 21 and an upper end of this spring member 28 a spring adjuster 29 for adjusting a load is provided. This spring adjuster 29 is inserted into a center of the core 21 electromagnetic coil 30 for exciting the magnetic field circuit is wound on a bobbin 31 and an outer periphery of the coil 31 is molded according to a plastic material. A terminal 32 of the coil 30 is combined with a terminal of the control unit not shown in figure.

On the other hand, in the fuel injector 10, a guide for regulating a move in an axial direction of the valve body 25 of the fuel injector 10 is carried out according to an inner wall of a cylindrical form fuel swirl: portion 33 which is inserted into an inner wall of a guide portion 23*a* and a hollow portion of the nozzle portion 26. This fuel swirl portion 33 is one for a fuel atomization means. To the nozzle portion 26, continuing the cylindrical form fuel swirl portion 33, the seat face 27 for seating the valve body 25 is formed and in a central portion of the seat face 27, a fuel injection hole 36 is provided for passing-through the injection fuel.

FIG. 3(*a*) and FIG. 3(*b*) are longitudinally cross-sectional views showing an enlarged valve portion of the fuel injector 10. FIG. 3(*a*) is a cross-sectional view showing the valve portion of the fuel injector 10, and FIG. 3(*b*) is a cross-sectional view showing the valve body 25 of the fuel injector 10 in a N direction of FIG. 3(*a*).

The fuel is introduced from an upper portion of the valve body 25 and reaches the fuel swirl portion 33. In the fuel injection hole 36 of the nozzle portion 26 to secure fully a swirl energy, this fuel introduced from an axial direction passage 34 is constituted a radial direction passage 3.5 which is formed eccentrically against a valve axial center. Further, when the valve body 25 is opened, between a ring form gap formed between the valve body 25 and the seat face 27, not to generate a friction loss, the fuel is directed to the fuel injection hole 36 and this constitution is one of the atomization means.

Further, the valve body 25 of the fuel injector 10 performs a high speed operation by increasing an attractive force of the coil 30. An opening and closing operation may be accomplished in a short time according to the pressure in the fuel injector 10 and a high speed drive of the valve body 25, and an abrupt change in the pressure of the injection fuel during the operation of the fuel injector 10 can be carried out. With this constitution, the swirl energy is enabled to heighten fully and then the atomization degree of the fuel spray 15 is secured.

The fuel injection hole 36 of the fuel injector 10 is designed to discharge effectively the supply energy to an outside of the fuel injection hole 36. Further, the atomization means to which the swirl of the fuel is not utilized, for example, this embodiment according to the present invention can be utilized to a method in which from a narrow ring form gap the fuel is injected and a thin film of the injection fuel is formed and the atomization degree of the fuel spray 15 is heightened.

An embodiment of the fuel spray formation according to the fuel injector 10 will be explained referring to FIG. 4 and FIG. 5. FIG. 4(*a*) is a cross-sectional view showing a constitution in which a L form cut (bisection) portion is provided to direct to the seat face 27 side from the fuel injection hole 36 of the fuel injector 10 and FIG. 4(*b*) is a plan view showing a surrounding portion including the fuel injection hole 36 of the fuel injector 10.

As stated above, a bottom portion 37 of the nozzle portion 26 of the fuel injector 10 is formed with a first surface 41 and a second surface 42. In the first surface 41 of the bottom portion 37 of the nozzle portion 26, an outer surface portion in an outlet side of the fuel injection hole 36 includes the above stated fuel injection hole outlet and the first surface 41 has a wall 38 for opposing the injected spray 15 which is projected from the first surface 41. In this embodiment according to the present invention, the first surface 41 and a surface of the wall 38 form a L shape surface configuration or makes a L shape step. The second surface 42 of the bottom portion 37 of the nozzle portion 26 of the fuel injector 10 is separated with a distance of h from the above stated fuel injection hole 36.

The first surface 41 is formed with a face 43 including the above stated fuel injection hole 36 and a face 44 which is projected in an upper direction from the face 43 and is provided lower than the first surface 41 taking into consideration from the upstream side. In the bottom portion 37 of the nozzle portion 26 of the fuel injector 10, the first surface 41 and the wall 38 in the outlet side of the fuel injection hole 36 are formed with a L shape configuration. The wall 38 is separated in a part thereof from the fuel injection hole 36 with the distance and is opposed to the fuel spray 15 to be subjected to the injection.

With this constitution of the fuel injector 10, the fuel injected from the fuel. injection hole 36, since a P portion being an outlet thereof is near to the seat portion with Lo from a Q portion, the fuel is discharged in advance from the P portion than the Q portion and as to the swirl energy in this time there is a relationship about the swirl energy of the P portion is larger than the swirl energy of the Q portion.

Further, in the Q portion side since the wall 38 opposed to the fuel spray 15 exists, the swirl energy in this direction causes a loss according to the wall face. Accordingly, the spread angle of the fuel spray 15 in the P portion direction is large (i.e., the fuel spray amount is large, namely the rich spray (the richly concentrated region)) but the spread angle of the fuel spray 15 in the Q portion direction is small (i.e., the fuel spray amount is small, namely the medium spray (the medium concentrated region)). Further, by the restriction of the wall 38, the fuel spray 15 is further made flatly and the fuel spray becomes the substantially two-direction orientation and the integrated spray 15 is generated. As a result, the asymmetric form spray 15 having the lean concentrated region 16, the medium concentrated region 19 and the richly concentrated region 18 is formed, as shown in FIG. 1(*c*).

Further, the wall 38 is separated from the fuel injection hole 36 by a dimension of h as stated in above, by the sizes or the largeness of this dimension h and the cut depth (the insertion depth) Lo, a desirable spread (the deflection) angle and the flatness degree of the fuel spray 15 can be suitably adjusted.

FIG. 5 shows a construction in which a rectangular form cut portion (the insertion portion) is provided in the seat face 27 side from the outlet end face of the fuel injection hole 36 and has a face 45. Similarly to, in the fuel to be injected, since a R portion being an outlet thereof is near to the seat portion with L1 from Q portion, the fuel is discharged in advance from the P portion than the Q portion and as to the swirl energy in this time there is a relationship about the swirl energy of the R portion is larger than the swirl energy of the Q portion. In this case, in both of the R portion and the Q portion, since walls 39 opposed to the fuel spray 15 exist, the walls 39 receive the restriction.

Accordingly, the spread angle of the fuel spray 15 becomes smaller than that of the above, however according to the restriction by the walls 39, the fuel spray 15 is further made flatly and the substantially two-direction orientation spray embodiment becomes strong. A diameter of the fuel injection port 36 of the nozzle portion 26 of the fuel injector 10 is expressed as do, and a horizontal length of the distance between the two walls 39 is expressed as H. Further, the walls 39 are separated with a dimension of H/do from the fuel injection hole 36, similarly to that stated above, by the sizes or the largeness of this dimension H/do and the cut depth L1, a desirable spread (the deflection) angle and the flatness degree of the fuel spray 15 can be suitably adjusted.

With the construction stated above, since the walls 38 and 39 are formed by separating with h from the fuel injection hole 36 and opposing to the fuel spray 15 to be subjected to the injection, the fuel spray 15 can be made flatly and deflected. This flatness and deflection spray 15 is deflected according to the strength of the intake air flow 8, in particular the intake air flow control device 7 and then since the fuel spray 15 is oriented and contacted to the intake air flow 8 which has became to the strong flow, the fuel adhesion to the intake air inner wall face 32 can be restrained, the mixture of the fuel with the air can be promoted. The linear construction of the wall shown in FIG. 4 or FIG. 5 can be formed with a curve form construction of a wall 38A shown in FIG. 6.

In the case of FIG. 4, a size h can form to be (0.05–0.1) do, namely h=(0.05–0.1) do. In the case of FIG. 5, h can form to be (1.1–1.2) do, namely h=(1.1–1.2) do. Accordingly h can be adjusted with a range (0.05–1.2) do, namely h=(0.05–1.2) do.

Referring to FIG. 1, an operation of the fuel injector 10 of this embodiment according to the present invention will be explained.

The fuel injector 10 carries out an opening and a closing of the seat face 27 by operating the valve body 25 according to an electric on-off signal which is given, to the electromagnetic coil 30 and according to this the injection control of the fuel is carried out. When an electric signal is given to the electromagnetic coil 30, the magnetic field circuit is formed according to the core 21, the yoke 20 and the plunger 22. The plunger 22 is attracted to the core 21 side and the plunger 22 is moved, the valve body 25 which is formed as one body with these elements is moved and the valve body 25 is separated from the seat face 27 of the valve seat of the nozzle portion 26 and then the fuel injection hole 36 is released.

The fuel is pressurized and adjusted through a fuel pump (not shown) and a regulator for regulating a fuel pressure (not shown) and the fuel enters into the interior portion of the fuel injector 10. The fuel passes through the inner portion passage of the valve body 25, the outer peripheral portion of the valve body 25, the axial direction passage 34 of the fuel injection swirl portion 33 and the radial direction passage 35 of the fuel injection swirl portion 33 and directs to the fuel injection hole 36 which is the downstream portion spray formation means.

Figure 7:
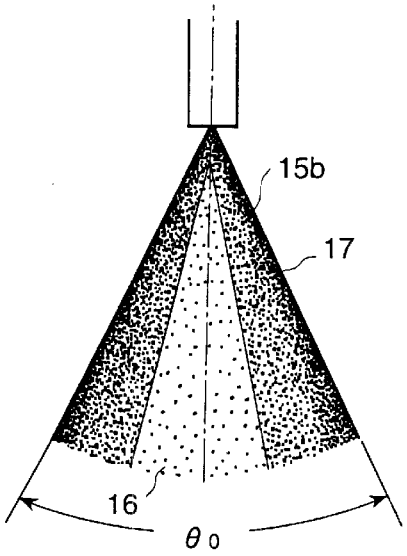
FIG. 7(*a*) is a cross-sectional view showing a fuel spray of a fuel injector having the L type injection hole.
Figure 7:
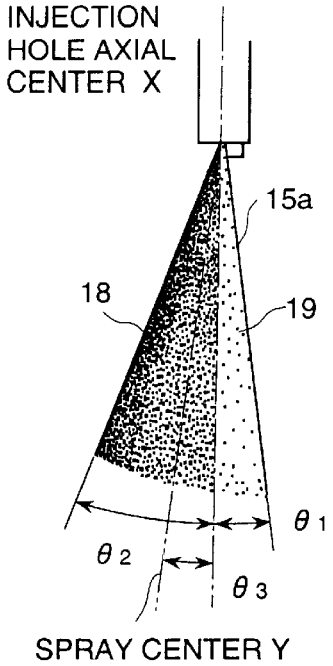

FIG. 7 is a tomogram schematic view in which the fuel injector 10 having the L type injection hole of this embodiment according to the present invention shown in FIG. 4 is installed to an injecting vessel and is measured. FIG. 7(*a*) shows a fuel spray (a spread angle of Eo) which is obtained when the injection hole shown in FIG. 4 is seen from a left direction and FIG. 7(*b*) shows a fuel spray which is obtained 1 then the injection hole shown in FIG. 4 is seen from a front direction.

The fuel spray 15 shows a state in which the fuel spray 15*b* is separated substantially in two directions. In the fuel spray 15*a*, against the injection bole axial center X, the spread angle of θ1 is smaller than the spread angle of θ2. The spread angle of θ2 is a direction in which the restriction by the wall 38 does not appear and the fuel spray amount thereof is large.

On the other hand, the spread angle θ1 is the wall 38 side, the fuel spray amount thereof is small. Further, an angle of θ3 is a displacement angle between the fuel spray center Y and the injection hole axial center X and this shows the deflection angle. When the fuel injector 10 is mounted on the internal combustion engine the spread angle θ direction of the fuel spray 15 is installed to direct to the inner wall face 9 of the intake air passage 5.

One example about the spread angles will be shown, in FIG. 7(*b*), the spread angle θ is 10 (ten) degrees the spread angle θ2 is 20 (twenty) degrees, and the angle θ3 is 5 (five) degrees, and (θ1+θ2) is 30 (thirty) degrees and the angle θ0 is 50 (fifty) degrees.

Figure 8:
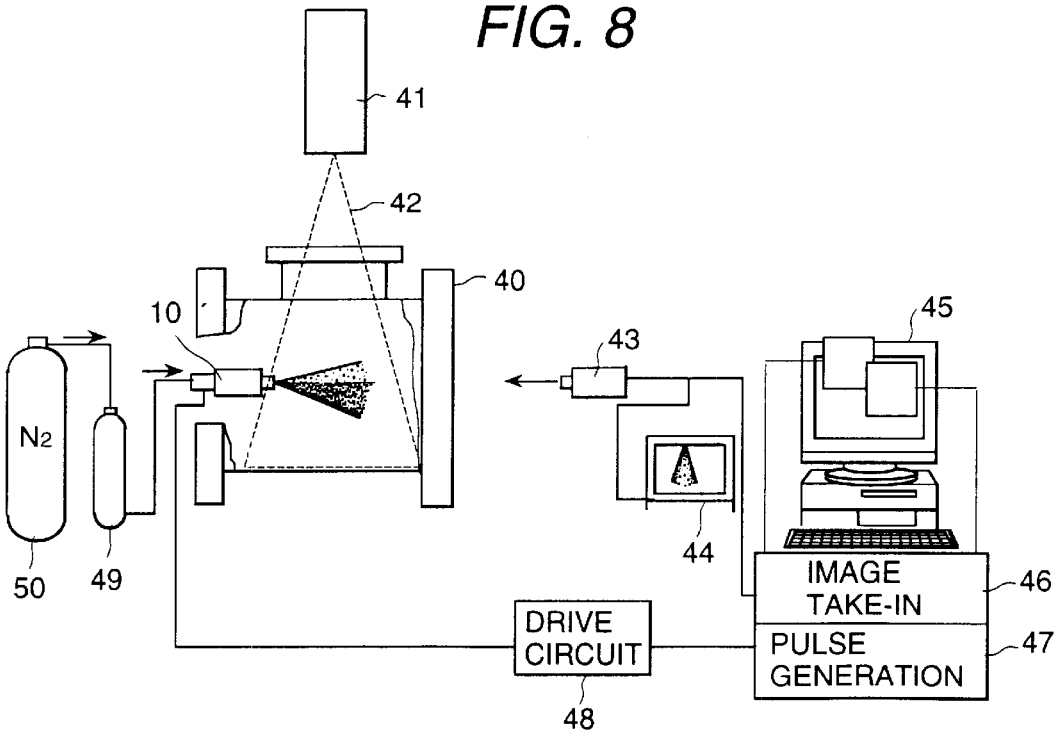
FIG. 8 is an explanatory view showing a fuel spray measurement apparatus of the fuel injector.

FIG. 8 shows a measurement device of the above stated spray 15. A reference numeral 40 is a cylindrical form spray vessel and to three sides thereof an optical lens is arranged and one side thereof the fuel injector 10 is installed. A laser irradiation device 41 generates a seat light 42 according to a slit which is provided on a lamination portion and by rotating the seat light 42 the seat light 42 is irradiated on a longitudinal and lateral cross-section of the fuel spray 15.

Further two sides, a photography use camera enable to adjust a zoom direction of an image and a left and right direction is provided, and then the fuel spray can be observed by a monitor 44. Further, a reference numeral 45 is a personal computer and provides an image take-in portion 46 and a pulse generating portion 47 for giving an opening valve command to the fuel injector 10. Further, a reference numeral 48 is a drive circuit and a reference numeral 49 is a fuel tank and is pressurized and adjusted by $N_2$ cylinder 50.

During an experimentation, "Shell LAWS" (Shell Chemical Co.: a product name "LAWS") in which the characteristics thereof resemble to those of the gasoline is used as a substitute product. Further, the pressure in the fuel spray vessel 40 can be reduced-pressure adjusted or applied-pressure adjusted by a vacuum pump and the $N_2$ cylinder 50.

A main measurement procedure is as follows, namely an establishment of the valve opening command to the fuel injector 10→an establishment of a timing for irradiating the laser seat 10→a drive of an image take-in shift an output of the valve opening command→a take-in of the image→a preservation of the image.

Using the above stated measurement device, the effects of the wall 38, the effect of the fuel spray 15 which is formed with the flatness and the adhesion dissolution conditions to the inner wall surface of the fuel spray 15 according to the controlled intake air flow 8 were confirmed.

Figure 9:
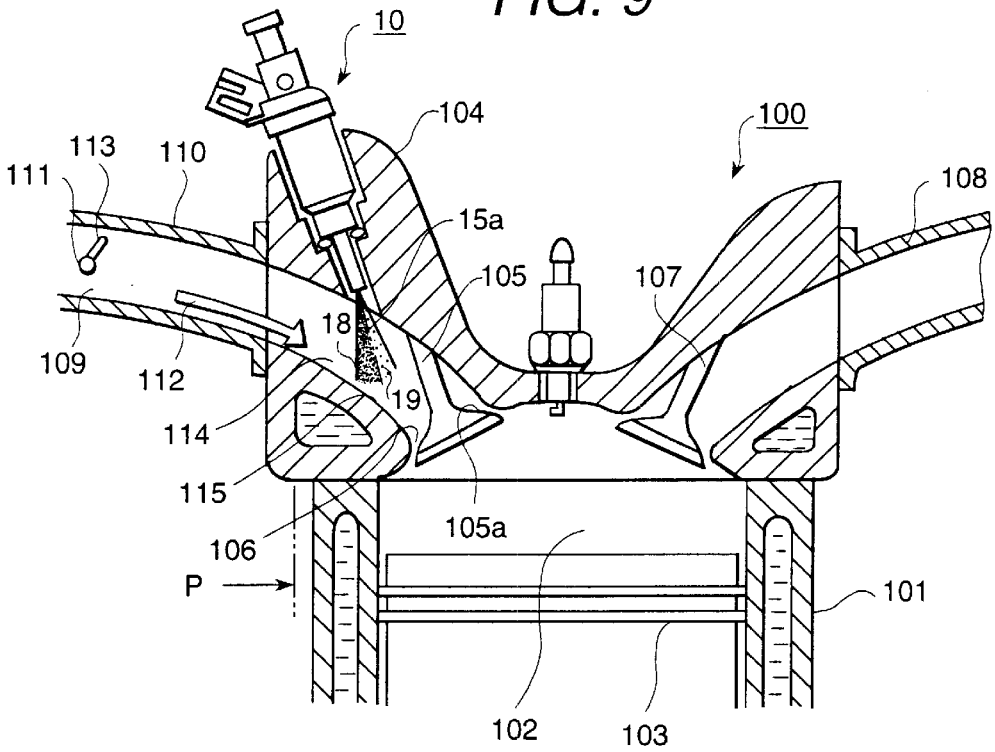
FIG. 9 is a partially cross-sectional view showing one cylinder of a multi-cylinder internal combustion engine in which a fuel injection apparatus (a fuel injector) of another embodiment according to the present invention in which the fuel injection apparatus is applied to a cylinder head of an internal combustion engine.
Figure 10:
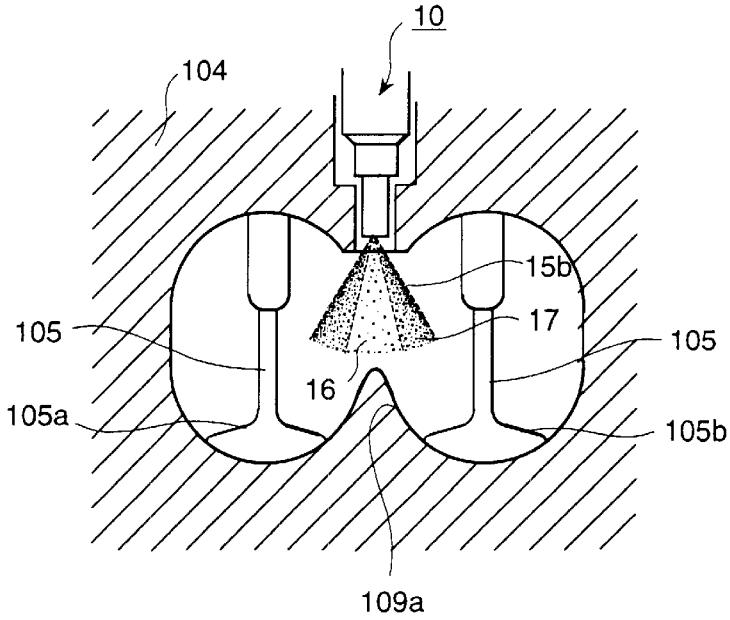
FIG. 10 is a view showing a relationship between an intake port and a fuel spray.

Next, another application example to a multi-cylinder internal combustion engine of a fuel injector 10 according to the present invention will be explained. FIG. 9 is a view showing a mounting state of a cylinder head of the multi-cylinder internal combustion engine, and FIG. 10 is a view showing a relationship between a position of the intake valve and the fuel injector 10 and the fuel spray 15.

A reference numeral 101 is one of the cylinders of the multi-cylinder internal combustion engine, a reference numeral 102 is a combustion chamber, a reference numeral 103 is a piston, a reference numeral 104 is a cylinder head, a reference numeral 105 is an intake valve for opening and closing an intake air port 106, a reference numeral 107 is an exhaust valve, a reference numeral 108 is an exhaust manifold.

A reference numeral 109 is an intake air passage having a central partition wall 109 which divides into the intake port 106 and is communicated in an upstream side of the intake port 107, a reference numeral 110 is an intake manifold, a reference numeral 111 is an intake air flow control device, a reference numeral 112 is a flow of the intake air, a reference numeral 115 is an inner wall face of an intake air passage 114 which opposed to an inner wall face of a fuel injector 10 side and, a reference numeral is a schematic view of a fuel spray which is injected from the fuel injector 10. In this embodiment according to the present invention, the fuel injector 10 is installed to the cylinder head 104.

The intake air flow control device 111 has an opening and closing valve 113. The two intake-valves 105 are arranged in parallel, in this embodiment according to the present invention, the fuel spray 15 is injected to direct to the intake ports 105*a* and 105*b*. The fuel injector 10 is arranged singly in the upstream side of the intake valve 105 and employs a fuel injection system in which a multi-point injection (MPI) system is utilized.

In this embodiment according to the present invention, to improve the quality and the formation state of the air-fuel mixture in the cylinder 101, the fuel injector 10 in which the atomization of the fuel spray 15 is heightened is installed to the cylinder 101, the fuel adhesion to the inner wall face of the intake manifold 110 and the inner wall face of the intake air passage 109 does not occur.

Further, the fuel spray 15 embodiment from the fuel injector 10 is that to the inner wall face of the intake air passage in the cylinder head 104 the spread of the fuel spray 15 is small but to the opposed wall face 115 the spread of the fuel spray 15 is large. Further, as shown in FIG. 10, the fuel spray 15 is generated to avoid the adhesion of the fuel to the central wall partition wall 109*a* but the fuel spray 15 is oriented to dish portions 105*a* and 105*b* of the intake valve 105.

On the other hand, when the intake valve 105 is opened, an air flow having a strong fluidization which is flown from the intake air control device 111 transports the fuel spray 15. As stated above, the optimization about the orientation and the shape of the fuel spray 15 is devised and a transportation delay of the fuel spray 15 to the combustion chamber 102 of the engine can be dissolved. Further, as to the intake air flow control device 111, as shown in the figure, the closing time of the intake air flow control device 111, the passage area of the intake manifold 110 is made narrow and then the velocity of the intake air flow 112 is heightened and the tumble flow is generated in the combustion chamber 102 of the engine.

FIG. 11 is a longitudinal cross-sectional view of a tip end portion of another fuel injector 10 of another embodiment according to the present invention. In this embodiment, as a manner for generating the flatness and deflection spray 15, plural fine holes are used. FIG. 11(*b*) is a R direction view of FIG. 11(*a*).

A valve body 64 is comprised of a rod 62 which is formed by rounding a plate form member having an opening, portion 60*a* partially in an inner peripheral face of an anchor 60 comprised of a magnetic material and a ball 63 member which is welded and fixed to another opening end portion of the rod 62. The valve body 64 is guided by an outer peripheral portion of the anchor 60 and an outer peripheral portion of the ball member 63 and is seated stably to a valve seat face 66 of a nozzle body 65.

Further, to the ball member 63, plural cut faces 63*a* for passing through the fuel are provided. The nozzle body 65 is inserted under pressure to an inner peripheral face 61 a of a thin form cylindrical member 61 comprising a non-magnetic member or a weak magnetic member and in a downstream thereof an injection plate 67 is inserted under pressure and fixed.

A reference numeral 68 is a welding portion using a laser and in this case an outer peripheral portion of the injection plate 67 can prevent leakage of the fuel to an outside portion. A reference numeral 70 is a plastic forming body which is formed by an injection molding and between this plastic forming body 70 and one end face side of another plastic forming body 71, an air sealing use O ring member 71 is provided.

Hereinafter, an operation of the fuel injector 10 will be explained. In accordance with an electric on-off signal given to an electromagnetic coil, the valve body 64 is moved in an up direction and a down direction in an axial direction and an opening and closing of a gap between the ball member 63 and the valve seat face 66 is carried out, accordingly the injection control of the fuel is carried out. When the valve body 64 is moved, the ball member 63 which is formed as one body to the valve body 64 is moved, and the ball 63 is separated from the valve seat face 66 of the nozzle body 65 and then in the upstream side of the injection plate 67 the fuel passage is released. In this time, the fuel is injected from the fuel injector 10 to an outside portion.

Herein, the construction of the injection plate will be explained referring to an embodiment shown in FIG. 12(*a*). FIG. 12(*a*) is an example of an injection plate 67 in which plural fine holes 72 and 73 are provided partially on a concentric circle. The respective diameter of the fine holes 72 and 73 formed equal and in particular a position for releasing the fine holes 73 is established to be a range of angle θ having more than 100 degrees.

A construction of an injection plate shown in FIG. 12(*b*) is basically the same as that of the FIG. 12(*a*), however the size of the inner side holes 76 is established to be small in comparison with that of the outer side holes 75. In this case, the fuel spray amount of the outer side becomes large.

A construction of an injection plate shown in FIG. 12(*c*) bows an injection plate 77 in which plural slit injection boles 78 and 79 are provided partially on a concentric circle. The size of the inner side injection holes 79 is established to be smaller in comparison with that of the outer side injection holes 78. In this case, the fuel spray amount of the outer side becomes large.

A construction of an injection plate shown in FIG. 12(*d*) shows an injection plate 80 in which plural slit injection holes 81 are provided partially on a concentric circle. An arrangement of the slit holes injection holes 81 is arranged in C shape as shown in FIG. 12(*d*).

These plural injection plates 67, 74, 77, 80 having plural fine injection holes stated in the above embodiments according to the present invention are formed with a metal member having a thin thickness plate shape (0.08 mm–0.15 mm, degree in the thickness). A processing of the injection plate is carried out by a pressing formation, an etching formation, etc. The injection plate can be produced large quantity and without a dispersion.

In the above stated embodiments according to the present invention, the following considerations and features are obtained. As to the atomization improvement of the injection fuel, by the provision of the injection plate having the fine injection holes the fuel flow velocity is heightened, and accordingly the atomization improvement of the injection fuel can be performed.

As to the orientation control of the fuel spray, the orientation control of the fuel spray can be adjusted by the inclination of the injection plate having the fine injection holes and the range for opening the fine holes and the respective spray injected from the fine holes is made to avoid interference with each other.

An adjustment of the injection amount of the fuel injector is determined according to a total area of the fine injection holes provided on the injection plate, however as to an individual dispersion, since the injection plate of the fuel injector is performed according to the press punching processing and the etching processing etc., a dispersion in dimension.

Further, in the installing time, since the outer peripheral portion of the injection plate is adhered and fixed according to the laser welding manner, the fixing position is made to separate remotely from the injection holes. Accordingly, the fuel injector does not receive the deformation according to the heat.

According to the present invention, in a fuel injection method of an internal combustion engine comprising an intake valve device for opening and closing an intake port, and a fuel injector arranged in an upstream side of the intake, valve device and driven by a control signal from an engine control device apparatus, a fuel injection by the fuel injector is synchronized to an intake stroke of the internal combustion engine, wherein forming a fuel spray injected from the fuel injector to a central portion spray having a lean concentrated region and an outer side portion spray, forming the outer side portion spray to a rich spray portion having a richly concentrated region and having a wide spread angle and a medium spray portion having a medium concentrated region and having a narrow spread angle in a peripheral portion thereof, and generating an integrated flatness spray body and the atomization degree of the fuel spray is heightened to have 30–50 $\mu$m and further the velocity of the intake air flow is controlled to be 15–50 m/s (the idling target rotation number is 2000 rpm under the water temperature of −30 degrees; the idling target rotation number is 600 rpm under the water temperature of 80 degrees), and the fuel spray rides the intake air flow and is transported to the intake valve device. As a result, the fuel spray adhesion to the inner wall of the cylinder head can be prevented effectively.

As stated above, according to the present invention, in the fuel injection apparatus in which the multi-pointed injection (MIP) system is employed, to attain the improvement of the quality of the air-fuel mixture in the cylinder and the formation state, the atomization degree of the fuel spray injected from the fuel injector is heightened and the atomized spray is supplied into the intake manifold, and also the fuel spray is transported by riding on the intake air flow in which the velocity is speed up, and the fuel spray is made flatly and deflected and the fuel adhesion to the inner wall face of the cylinder head is restrained, then the mixture of the fuel spray is promoted. As a result, the combustion improvement of the internal combustion engine can be attained the improvement in the exhaust gas and the improvement of the fuel consumption can be attained. Further, with this construction, since the alternation of the installation layout of the base engine is not occurred, the reduction in cost can be obtained.

What is claimed is:

1. A fuel injection method of an internal combustion engine comprising an intake valve device for opening and closing an intake port, and a fuel injector arranged upstream from said intake valve device and driven by a control signal from an engine control device apparatus, a fuel injection by said fuel injector being synchronized to an intake stroke of the internal combustion engine, said method comprising:

forming, from a fuel spray injected from said fuel injector, a central spray portion having a lean concentrated region and an outer spray portion;

forming, from said outer spray portion, a rich spray portion having a richly concentrated region and a wide spread angle, and a medium spray portion having a medium concentrated region and a narrow spread angle in a peripheral portion thereof; and generating an integrated flatness spray body.

2. A fuel injection method of an internal combustion engine according to claim 1, wherein said fuel injector includes two intake valve fuel injections in which said two intake valves are provided side by side; and said method comprises orienting said spray portion having said richly concentrated region and said wide spread angle to an inner wall which is opposed to an inner wall of a fuel injection valve arrangement of said intake valve device to which said fuel injector is arranged and symmetrically orienting said spray portion to a central partition wall positioned in a center portion of said two intake valves.

3. A fuel injection method of an internal combustion engine comprising an intake valve device for opening and closing an intake port, a fuel injector arranged upstream from said intake valve device and driven by a control signal from an engine control device apparatus, an intake air flow control device for controlling an intake air flow, and a fuel injection by said fuel injector being synchronized to an intake stroke of the internal combustion engine, said method comprising:

forming, from a fuel spray injected from said fuel injector, a central spray portion having a lean concentrated region and an outer spray portion;

forming said outer portion spray to include a rich spray portion having a richly concentrated region and a wide spread angle and a medium spray portion having a medium concentrated region and a narrow spread angle in a peripheral portion thereof;

generating an integrated flatness spray body;

arranging said rich spray portion having said richly concentrated region and said wide spread angle of said fuel injector to orient an intake air flow which is fluidization-controlled according to said intake air flow control device; and transporting said spray to said intake port according to said intake air flow.

4. A fuel injection method of an internal combustion engine according to claim 3, wherein said rich spray portion having said richly concentrated region and said wide spread angle is oriented to an inner wall opposed to an inner wall of a fuel injector arrangement of an intake manifold to which said fuel injector is arranged.

5. A fuel injection method of an internal combustion engine comprising an intake valve device for opening and closing an intake port, a fuel injector arranged upstream from said intake valve device and driven by a control signal from an engine control device apparatus, and an intake air flow control device for controlling an intake air flow, a fuel injection by said fuel injector being synchronized to an intake stroke of the internal combustion engine, said method comprising:

generating a fuel spray injected from said fuel injector to a flatness spray body including a fuel spray portion having a wide spread angle and a fuel spray portion having a narrow spread angle;

heightening an atomization degree of an intake air flow to have 30–50 $\mu$m;

controlling said intake air flow to have a velocity of 15–30 m/s; and transporting said spray to said intake valve device by riding said intake air flow.

6. A fuel injector of an internal combustion engine, said fuel injector being driven according to a control signal from an engine control device, the fuel injector comprising:

a cylindrical form nozzle portion having a space formed on an interior portion thereof and a fuel injection hole formed in a bottom portion thereof, a seat face continued to said fuel injection hole and formed on said bottom portion of said nozzle portion, a valve body arranged in said space of said nozzle portion, a gap being formed by said valve body with said seat face, a fuel swirl portion formed by said space and arranged in a surrounding portion of said valve body, wherein said bottom portion of said nozzle portion includes a first surface and a second surface, said first surface in an outer surface portion in an outlet side of said fuel injection hole including said outlet side of said fuel injection hole and a wall separated from said fuel injection hole and opposed to a fuel spray to be subject to the injection, and said second surface is projected from said first surface.

7. A fuel injector of an internal combustion engine according to claim 6, wherein said first surface is formed with a face including said fuel injection hole and a face continued to said first face and formed in a lower portion of said first surface.

8. A fuel injector of an internal combustion engine according to any one of claim 6 and claim 7, wherein a surface of said wall is formed with one of a linear shape and a smoothly curved shape.

9. A fuel injector of an internal combustion engine, said fuel injector being driven according to a control signal from an engine control device, the fuel injector comprising:

a cylindrical form nozzle portion having a space formed in an interior portion thereof and a fuel injection hole formed in a bottom portion thereof, a seat face continued to said fuel injection hole and formed on said bottom portion of said nozzle portion, a valve body arranged in said space of said nozzle portion, a gap formed by said valve body with said seat face, a fuel swirl portion formed by said space and arranged in a surrounding portion of said valve body, wherein in said bottom portion of said nozzle portion, an outer surface portion of an outlet side of said fuel injection hole is formed with a L shape and in a part of said surface another face separated from said fuel injection hole is formed for opposing to a fuel spray to be subjected to the injection.

10. A fuel injection apparatus for an internal combustion engine, the fuel injection apparatus comprising an intake valve device for opening and closing an intake port, a fuel injector arranged upstream from said intake valve device and driven by a control signal from an engine control device apparatus, and an intake air flow control device arranged near the fuel injector and for controlling an intake air flow, a fuel injection by said fuel injector being synchronized to an intake stroke of the internal combustion engine, wherein said fuel injector has a cylindrical form nozzle portion in which a space is formed in an interior portion thereof and a fuel injection hole is formed in a bottom portion thereof;

in said bottom portion of said nozzle portion, an outer surface portion of an outlet side of said fuel injection hole is separated from said fuel injection hole and a wall formed by opposing a fuel spray to be subjected to the injection, a face of said wall is arranged to direct in an orthogonal direction with an intake air flow which is fluidization-controlled by said intake air flow control device.

11. A fuel injection method of an internal combustion engine in which fuel is injected upstream of an intake port in which air is taken to a combustion chamber of the internal combustion engine, said method comprising:

providing an intake air control device provided in an intake air passage for communicating to said intake port;

generating a flow velocity distribution in a lateral cross-section of said intake air passage to the air for flowing into said intake air passage;

concentrating fuel in a region formed on said lateral cross-section of said intake air passage;

heightening a flow velocity of said region of said lateral cross-section of said intake air passage by said intake air flow control device;

riding the fuel injected to said region on an intake air flow in which the flow velocity has heightened; and transporting the fuel into said combustion chamber.

12. The fuel injection method of an internal combustion engine according to claim 11, wherein injecting the fuel to a first face wall portion of said intake air passage to which said fuel injector is installed and to a second face wall portion of said intake air passage which opposes said first face wall portion through said intake air passage.

13. The fuel injection method of an internal combustion engine according to claim 11, wherein injecting a fuel spray to a first face wall portion of said intake air passage to which said fuel injector is installed and injecting a fuel spray to a second face wall portion of said intake air passage which opposes said first face wall portion through said intake air passage; and forming a spread angle of said fuel spray to said second face wall portion wider than a spread angle of said fuel spray to said first face wall portion.

14. A fuel injection apparatus of an internal combustion engine in which fuel is injected upstream of an intake port in which air is taken to a combustion chamber of the internal combustion engine, the fuel injection apparatus comprising:

an intake air flow control device provided in an intake air flow passage for communicating said intake port and generating a flow velocity of a fuel spray in a lateral cross-section of said intake air passage to air which flows from said intake air passage;

a fuel injector for injecting the fuel to concentrate the fuel in a region in which a flow velocity of said fuel spray is heightened in the lateral cross-section of said intake air passage, wherein the fuel which has injected to said region rides on the intake air flow in which the flow velocity of said fuel spray is heightened.

15. A fuel injection apparatus of an internal combustion engine according to claim 14, wherein the fuel injected from said fuel injector is injected to a first face wall portion of said intake air passage to which said fuel injector is installed and is injected to a second face wall portion of said intake air passage which opposes said first face wall portion through said intake air passage.

16. A fuel injection apparatus of an internal combustion engine according to claim 14, wherein said injector injects a fuel spray to a first face wall portion of said intake air passage to which said fuel injector is installed and injects a fuel spray to a second face wall portion of said intake air passage which opposes said first face wall portion through said intake air passage; and a spread angle of said fuel spray to said second face wall portion is formed wider than a spread angle of said fuel spray to said first face wall portion.

* * * * *